US008616132B2

(12) United States Patent
Drager

(10) Patent No.: US 8,616,132 B2
(45) Date of Patent: Dec. 31, 2013

(54) APPARATUS AND METHOD FOR DISTRIBUTING IRRITANTS OR WARFARE AGENTS

(76) Inventor: Karl-Heinz Drager, Berlin (DE)

( * ) Notice: Subject to any disclaimer, the term of this patent is extended or adjusted under 35 U.S.C. 154(b) by 150 days.

(21) Appl. No.: 13/062,810

(22) PCT Filed: Sep. 3, 2009

(86) PCT No.: PCT/EP2009/006401

§ 371 (c)(1),
(2), (4) Date: May 19, 2011

(87) PCT Pub. No.: WO2010/025925

PCT Pub. Date: Mar. 11, 2010

(65) Prior Publication Data

US 2011/0219979 A1 Sep. 15, 2011

(30) Foreign Application Priority Data

Sep. 8, 2008 (DE) ..... 10 2008 046 246

(51) Int. Cl.
*F42B 12/46* (2006.01)

(52) U.S. Cl.
USPC ..... 102/502; 102/512; 102/513

(58) Field of Classification Search
USPC ..... 102/502, 512, 513
See application file for complete search history.

(56) References Cited

U.S. PATENT DOCUMENTS

| | | | | |
|---|---|---|---|---|
| 1,878,491 | A | 9/1932 | Goss | |
| 3,238,143 | A * | 3/1966 | Ainsley et al. | 102/334 |
| 3,404,810 | A | 10/1968 | Beers | |
| 3,437,245 | A * | 4/1969 | Herbert et al. | 222/389 |
| 3,596,603 | A | 8/1971 | Gryting et al. | |
| 3,656,435 | A | 4/1972 | Barr et al. | |
| 3,713,383 | A | 1/1973 | Crescenzo et al. | |
| 4,446,990 | A * | 5/1984 | Stevenson et al. | 222/82 |
| 5,018,449 | A | 5/1991 | Eidson, II | |
| 6,349,650 | B1 | 2/2002 | Brunn et al. | |
| 6,499,407 | B2 * | 12/2002 | Brum | 102/505 |
| 8,286,557 | B2 * | 10/2012 | Endicott et al. | 102/513 |

FOREIGN PATENT DOCUMENTS

DE 10 2006 016 286 A1 10/2007

* cited by examiner

*Primary Examiner* — Stephen M Johnson
(74) *Attorney, Agent, or Firm* — Greer, Burns & Crain, Ltd.

(57) ABSTRACT

An apparatus for distributing irritants or warfare agents includes a container having an interior for providing an irritant or warfare agent, which is dissolved or emulsified in a solution gas in its liquefied state of aggregation, which solution gas is in gaseous condition at room temperature and atmospheric pressure or ambient pressure. In addition, the container has at least one predetermined breaking point for producing an opening of the interior to the surroundings of the container at a predefined bursting pressure in the interior, and the apparatus further includes a pressure generator which can generate an increased pressure in the interior of the container that is greater than the bursting pressure of the at least one predetermined breaking point.

16 Claims, 7 Drawing Sheets

APPARATUS AND METHOD FOR DISTRIBUTING IRRITANTS OR WARFARE AGENTS

FIELD OF THE INVENTION

The present invention relates to an apparatus and a method for distributing irritants or warfare agents.

DESCRIPTION OF THE STATE OF THE ART

DE 10 2006 016 286 A1 discloses a system for very fine distributing and discharging irritants or warfare agents. In this known system an irritant or warfare agent is dissolved or emulsified in a pressure liquefied gas which is transported to the outlet nozzles of the system in its liquefied state of aggregation and is discharged in form of a liquid jet. During dissolving the irritant or warfare agent in the liquefied solution gas the crystal structure is decomposed and the molecules are distributed between the molecules of the solution gas.

Upon pressure drop below the evaporation pressure, the liquefied solution gas changes into the gaseous state of aggregation. This is prevented during the path of the solution gas up to the outlet nozzles of the system. Then, upon discharge from the outlet nozzles, the gas evaporates abruptly. The liquefied solution gas takes the energy being necessary for the evaporation from the ambient air. During expansion of the solution gas, the irritants or warfare agents added to it, together with the molecules of the gas, are torn apart compulsorily and with removing and preventing, respectively, the surface tensions and crystal structures, respectively. The expansion of the solution gas in this way achieves a very fine distribution of the irritants or warfare agents in the ambient air below droplet size or crystal formation, respectively.

Due to the necessary reservoirs for the solution gas and the irritants or warfare agents, line and valve systems as well as outlet nozzles, this conventional system is comparatively large and complex. In addition, some time is needed for discharging the irritants or warfare agents since the solution gas and, the irritants or warfare agents first have to be transported through the system up to outlet nozzles.

SUMMARY OF THE INVENTION

It is the object of the invention to provide an apparatus and a method for distributing irritants or warfare agents, which achieve a very fine distribution of the irritants or warfare agents and also enable a rapid discharge of the irritants or warfare agents with a simple and compact construction.

This object is achieved by an apparatus for distributing irritants or warfare agents comprising the features of claim 1 and a method for distributing irritants or warfare agents comprising the features of claim 13, respectively. Advantageous configurations and further developments of the invention are subject-matter of the respective dependant claims.

The inventive apparatus for distributing irritants or warfare agents includes a container having an interior for providing an irritant or warfare agent which is dissolved or emulsified in a solution gas in its liquefied state of aggregation, which solution gas is in gaseous condition at room temperature and atmospheric pressure or ambient pressure. The container has at least one predetermined breaking point, which produces an opening of the interior to the surroundings of the container at a predetermined bursting pressure in the interior. Further, the apparatus comprises a pressure generating means, which can generate an increased pressure in the interior of the container that is greater than the bursting pressure of the at least one predetermined breaking point.

This apparatus is characterized by a very simple and compact construction. Especially, no special reservoirs, line systems and outlet nozzles are necessary as with the conventional system described at the beginning. The at least one predetermined breaking point is put to burst by the pressure increase in the interior of the container so that a predefined opening of the interior to the surroundings of the container is produced very rapidly. At the moment of bursting of the at least one predetermined breaking point, the maximum release amount of the solution gas mixture is released immediately within fractions of seconds. The dissolution or emulsion of the irritants or warfare agents provided in the interior of the container is discharged from the produced opening promptly when the predetermined breaking point bursts. Thereby, the solution gas evaporates and expands promptly and achieves a great discharge range and a very fine distribution of the irritants or warfare agents in the ambient air in a similar manner as with the conventional system of DE 10 2006 016 286 A1.

With an appropriate choice of number and position(s) of the at least one predetermined breaking point, a target-oriented discharge of the irritants or warfare agents is achieved.

The simple and compact construction simplifies the production and reduces the production costs. The assembly of the apparatus is also very simply. Due to the lack of a line system the discharge times of the irritants or warfare agents are definitely shortened. This shortening of the discharge time improves the efficiency of the irritants or warfare agents because the desired concentration of irritants in the ambient air is established immediately. In this way, with the inventive apparatus, one can react upon a threat very rapidly and effectively.

In addition, the apparatus is configured very robust and does not include any sensitive or complicated components and, thus, is less accident-sensitive than conventional systems. The predetermined breaking point has a simple and also failsafe construction in comparison to a valve or an outlet nozzle.

The pressure increase in the interior of the container resulting in bursting of the at least one predetermined breaking point is at the same time used for achieving greater throwing ranges for the irritants or warfare agents by means of a pressure increase of the solution gas above its evaporation pressure.

Further, the apparatus of the invention includes no valves or the like. The container of the apparatus is closed completely and safely; not till an actuation of the apparatus an opening is produced at the at least one predetermined breaking point, through which the solution gas with the irritants or warfare agents can discharge. In this way, an unintentional leakage of the irritants or warfare agents as well as of the solution gas out of the container is prevented for sure.

Before further describing the invention and preferred embodiments, various terms shall be explained in detail.

A "predetermined breaking point" in the meaning of this invention releases an opening of a predetermined size by means of deformation and/or destruction of material at a predetermined bursting pressure. The predetermined breaking point may be formed by weakening of material or modification of material of the container or by a component such as a bursting disk provided in an opening of the container. The bursting disk is for example adhered, welded, screwed or in a different way sealingly put into the opening of the container.

The "bursting" of the predetermined breaking point is a process, during which the predetermined breaking point opens by means of deformation and/or destruction of material at the constructionally defined (bursting) pressure.

"Solution gases" are gases being liquefied under pressure or coldness, which serve as solvent or emulsion carrier for irritants or warfare agents, in their liquefied state of aggregation. In order that the solution gas evaporates and expands abruptly upon discharge from the container it has to be in its gaseous condition at room temperature and atmospheric pressure. In addition, it should have an evaporation temperature which is low in comparison to the ambient temperature such that a rapid evaporation is possible by energy transfer from the ambient air. As solution gases for example propellents or refrigerants can be used. For the use at low ambient temperatures, for example the refrigerant R413A is qualified as solution gas.

"Irritants" are agents, which in predetermined doses exert a stimulus to humans or animals without causing permanent health damage. Thereby, the stimulus effect depends on the concentration and kind of the acting irritant. The invention especially refers to irritants which primarily act via the skin, especially the mucosa, and the respiration without being limited to this kind of irritants. Thereby, it is irrelevant whether the respective irritants are synthetic substances (e.g. CS) or naturally occurring substances (e.g. OC) or a combination of synthetic substances and natural substances.

According to the Convention about Chemical Weapons, whether an "irritant" is also a "warfare agent" depends on the fact whether the substance can effect the death, a temporary incapacitation or a permanent damage of human or animal by, its chemical effects. In most cases, this depends essentially on the concentration of the used irritant. In addition, an irritant is only classified as a warfare agent if it is used in an armed conflict—contrary to a peaceable or civil, purpose.

The "very fine distribution" is to be understood as a distribution of irritants or warfare agents at which the size of the irritant or warfare agent particles is below a size commonly called mist. Especially, the irritants or warfare agents are distributed in the ambient air below droplet size or crystal formation, respectively. With regard to this very fine distribution and the mechanism for generating the same, the whole content of DE 10 2006 016 286 A1 mentioned above, which belongs to the same inventor and discloses this very fine distribution of irritants or warfare agents for the first time, is incorporated by reference.

In a configuration of the invention, the pressure generating means is configured and arranged such that it generates the pressure increase directly in the interior of the container. In an alternative configuration, the pressure generating means is configured and arranged such that it acts upon a movable piston to generate the pressure increase in the interior of the container by volume reduction of the interior. The last-mentioned configuration variante is advantageous especially when a contact of the solution gas or the irritants or warfare agents with the pressure generating means shall be prevented.

In an embodiment of the invention, the pressure generating means comprises a pyrotechnic charge the ignition thereof causing the pressure increase in the interior of the container.

In a different embodiment of the invention, the pressure generating means comprises a fluid source (gas or liquid) being separated from the interior of the container, from which a pressurized fluid can be taken to cause the pressure increase in the interior of the container.

In a different embodiment of the invention, the pressure generating means comprises an electrical drive for moving the piston.

In a further embodiment of the invention, an irritant or warfare agent being dissolved or emulsified in the solution gas is housed in the interior of the container. Alternatively, the container includes another room, and one of the components of the solution gas and the irritant or warfare agent is housed in the interior and the other thereof is housed in the other room. With the last-mentioned alternative, the separation between the interior and the other room can be removed either before an actuation of the pressure generating means or by the pressure generating means itself. Further, it is possible to house the irritant or warfare agent and the solution gas in two separated rooms of the container and to introduce both components into the interior to provide the desired dissolution or emulsion of the irritant or warfare agent in the solution gas.

According to the inventive method for distributing irritants or warfare agents, an irritant or warfare agent being dissolved or emulsified in a solution gas in its liquefied state of aggregation is provided in an interior of a container, wherein the solution gas is in its gaseous condition at room temperature and atmospheric pressure or ambient pressure, and wherein the container comprises at least one predetermined breaking point, which produces an opening of the interior to the surroundings of the container at a predetermined bursting, pressure in the interior. If required, the pressure in the interior of the container is increased above the bursting pressure of the at least one predetermined breaking point so that the solution gas with the irritant or warfare agent discharges through the opening arisen by the broken predetermined breaking point from the container and evaporates and expands immediately thereafter and, in this way, distributes the irritant or warfare agent into the ambient air.

In a configuration of the invention, the pressure increase is generated directly in the interior of the container and, in an alternative configuration of the invention the pressure increase in the interior of the container is generated by means of a volume reduction of the interior.

In a further configuration of the invention, an irritant or warfare agent dissolved or emulsified in the solution gas is housed in the interior of the container. In an alternative configuration of the invention, the solution gas and the irritant or warfare agent are housed in separated rooms of the container and are provided in the interior in a mixed condition before generating the pressure increase in the interior of the container.

BRIEF DESCRIPTION OF THE DRAWINGS

These and other features and advantages of the invention will be better understood from the following description of preferred, non-limiting embodiments with reference to the accompanied drawings, in which.

DETAILED DESCRIPTION OF PREFERRED EMBODIMENTS

Figure 1:
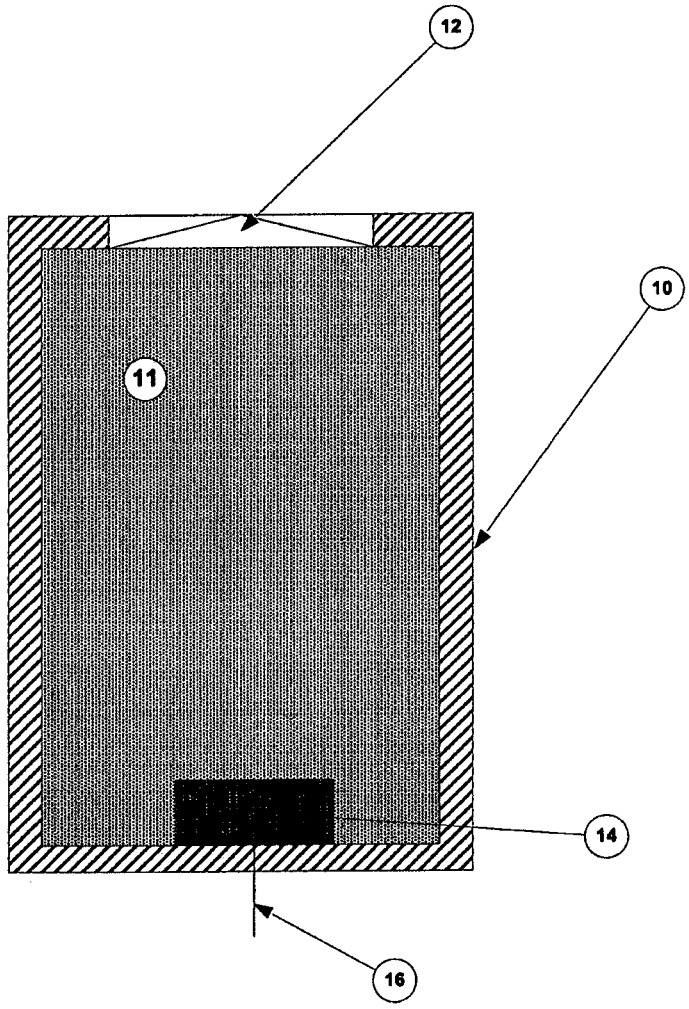
FIG. 1 shows a diagrammatic sectional view of an apparatus for distributing irritants or warfare agents according to a first embodiment of the invention.

FIG. 1 shows a first embodiment of an apparatus for distributing irritants or warfare agents according to the invention.

The apparatus comprises a container 10 of any design and size, in which an interior 11 is defined. Preferably, the container 10 is made of a metal or a plastic or resin material. In the interior 11, a dissolution or emulsion of an irritant or warfare agent (for example CS) in a solution gas (for example propane, butane, fluorocarbons, refrigerants, carbon dioxide, nitrogen) in its liquefied sate of aggregation is housed. At room temperature and atmospheric pressure or ambient pressure the solution gas is in gaseous condition and has an evaporation temperature being low in comparison to the ambient temperature.

The container 10 is provided with at least one predetermined breaking point 12. Number, position and size of the at least one predetermined breaking point 12 are chosen in dependence from the application case such that a target oriented discharge of the irritants or warfare agents can be achieved. The at least one predetermined breaking point 12 is for example a defined weakening of material and/or modification of material of the container 10. Alternatively, the predetermined breaking point 12 is formed by sealing (adhering, welding or the like) a predefined opening in the container 10 with for example a burst disk.

The at least one predetermined breaking point 12 is configured such that it produces the predefined opening in the container 10 at a predetermined bursting pressure in the interior 11 of the container 10.

In the condition of delivery of the apparatus, the pressure in the interior 11 of the container 10 is clearly below the bursting pressure of the at least one predetermined breaking point 12. In addition, the interior 11 of the container 10 is sealed. In this way, a leakage of the irritants or warfare agents and the solution gas from the container is prevented.

For generating the necessary overpressure in the interior 11 of the container 10 the apparatus is further provided with a pyrotechnic charge 14, which is coupled to an ignition means 16 (e.g. fuse). Pyrotechnic charge 14 and ignition means 16 form a pressure generating means in the meaning of the present invention. This pressure generating means 14-16 produces the pressure increase directly in the interior 11 of the container 10.

Upon actuation of the inventive apparatus of FIG. 1, firstly the pyrotechnic charge 14 in the container 10 is triggered by the ignition means 16. By triggering the pyrotechnic charge 14 explosion gas pressure, explosion heat and explosion shock wave are produced, which increase the pressure in the interior 11 of the container 10. If the inner pressure in the interior 11 exceeds the bursting pressure of the at least one predetermined breaking point 12 it bursts and immediately produces a predefined opening in the container 10. Then, the solution gas with the added irritants and warfare agents discharges from the container 10 through this opening, wherein the overpressure built up in the interior 11 at the same time serves for discharge acceleration of the solution gas so that greater discharge ranges are achieved than would have been effected by the evaporation pressure of the solution gas only.

Then, upon discharge from the opening of the container 10, the solution gas evaporates abruptly and expands. The liquefied solution gas takes the energy necessary for the evaporation from the ambient air. With the expansion of the solution gas the irritants or warfare agents added thereto together with the molecules of the solution gas are compulsorily torn apart, i.e. separated, while releasing or preventing, respectively, surface tensions and crystal structures. In this way, the expansion of the solution gas effects a very fine distribution of the irritants or warfare agents in the ambient air below droplet size or crystal formation, respectively.

Thereby, the discharge of the solution gas and the added irritants or warfare agents is performed within a very short time after actuation of the apparatus since the individual components do not have to be transported through lines, valves and nozzles beforehand. In addition, contrary to the use of a controlled opening valve, the whole opening in the container 10 is provided immediately so that the whole amount of irritants or warfare agents provided is discharged very rapidly and a sufficient irritant concentration in the ambient air is achieved, immediately.

Figure 2:
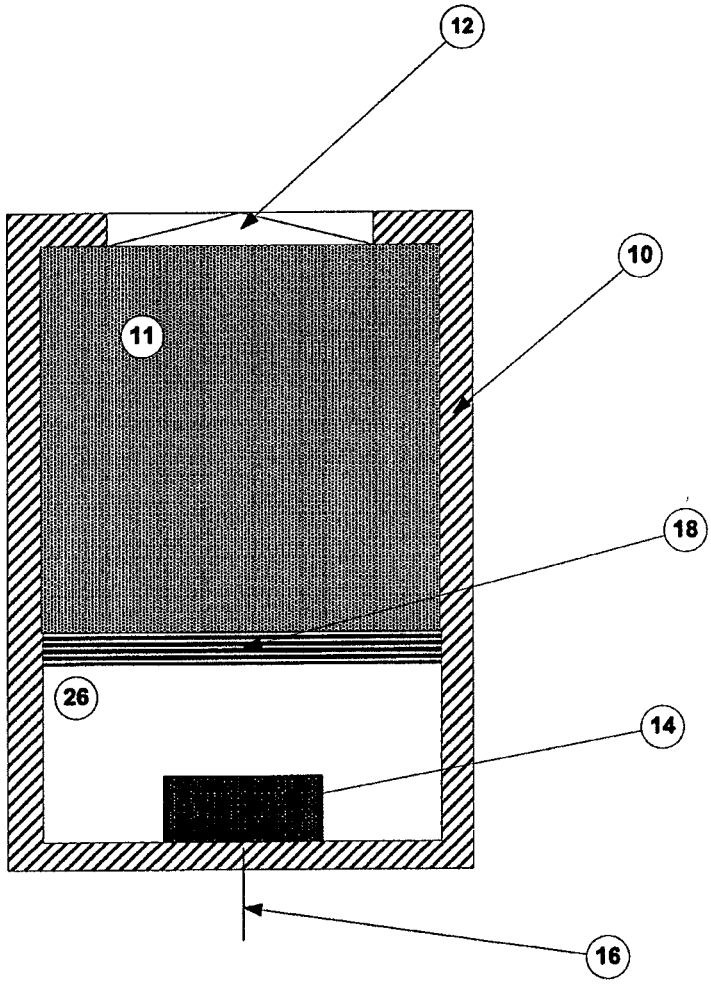
FIG. 2 shows a diagrammatic sectional view of an apparatus for distributing irritants or warfare agents according to a second embodiment of the invention.

FIG. 2 shows a second embodiment of an apparatus for distributing irritants or warfare agents.

With some kinds of solution gases and irritants or warfare agents, the direct introduction of combustion gases produced pyrotechnically may result in undesired chemical reactions. Therefore, it is advantageous in such cases to separate the pyrotechnic charge 14 from the solution gas mixture in the interior 11 of the container 10.

For this reason, the interior 11 of the container 10 is delimited by a movable piston 18 at least one side or position. Then, the pyrotechnic charge 14 is arranged on the side of the container 10 opposite to the interior 11. By triggering the pyrotechnic charge 14 the piston 18 is moved away from the charge 14 (upwards in FIG. 2) by means of the explosion gas pressure and, in this way, reduces the volume of the interior 11 of the container 10. The volume reduction of the interior 11 generates an overpressure in it, which exceeds the bursting pressure of the at least one predetermined breaking point 12, leading to the discharge of the solution gas mixture out of the container 10 and the very fine distribution of the irritants or warfare agents in the ambient air, in the same way as with the first embodiment above.

Figure 3:
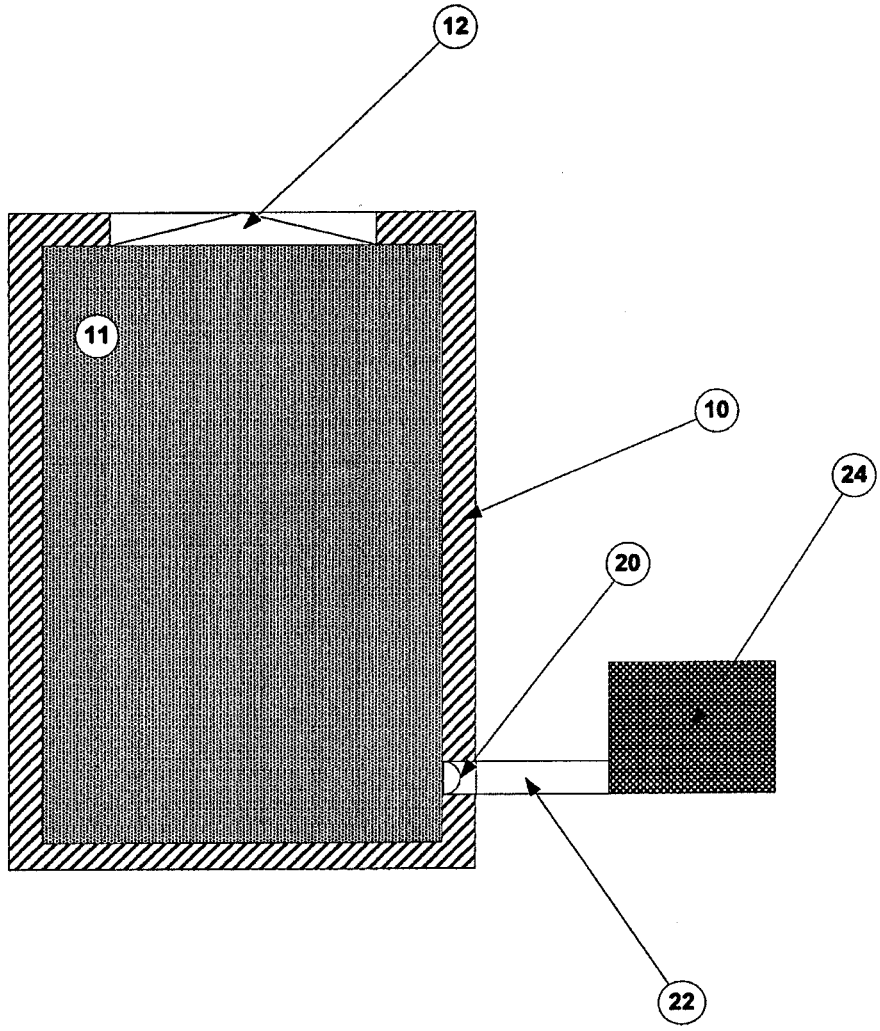
FIG. 3 shows a diagrammatic sectional view of an apparatus for distributing irritants or warfare agents according to a third embodiment of the invention.
Figure 4:
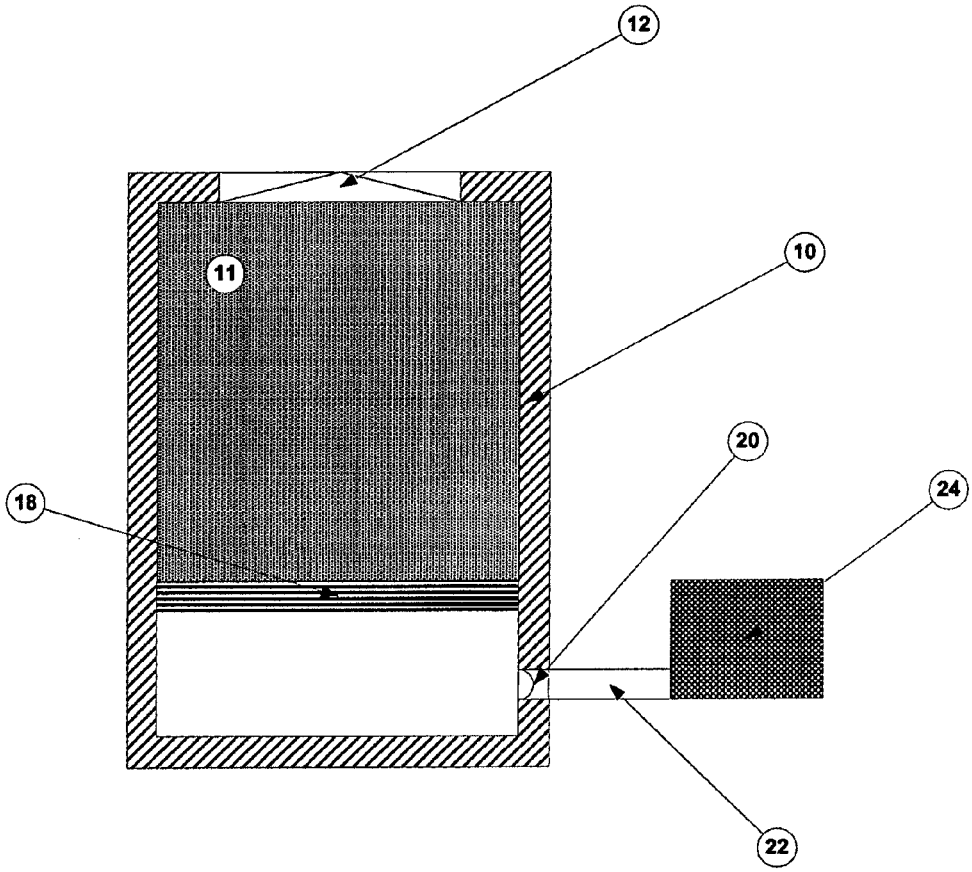
FIG. 4 shows a diagrammatic sectional view of an, apparatus for distributing irritants or warfare agents according to a fourth embodiment of the invention.

Referring now to FIGS. 3 and 4, a third and a fourth embodiment of an apparatus for distributing irritants or warfare agents are explained in detail.

Both configurations of FIGS. 3 and 4 each differ from the embodiments shown in FIGS. 1 and 2 in the kind of the pressure generating means. While the pressure generating means includes a pyrotechnic charge 14 in each of the first and second embodiments, in both embodiments of FIGS. 3 and 4, a fluid source 24 is an essential component of the pressure generating means.

As illustrated in FIGS. 3 and 4, a fluid source 24 is connected to the container 10 via a fluid line 22. In the third embodiment of FIG. 3, the fluid line 22 leads directly into the interior 11 of the container 10 containing the solution gas mixture. In the fourth embodiment of FIG. 4, however, the fluid line 22 leads into a sub room below a piston 18, which can be moved towards the interior 11 of the container 10.

For producing the pressure increase in the interior 11 of the container a fluid (gas, liquid) under pressure is led into the container 10 to generate an overpressure greater than the bursting pressure of the at least one predetermined breaking point 12 in the interior 11. The pressurized fluid of the fluid source 24 may for example be taken from a pressure container, taken from a reservoir and compressed, taken from a reservoir by means of pyrotechnical means or chemically produced. In case this fluid of the fluid source shall not get into contact with the solution gas mixture in the interior 11 of the container 10, because this possibly may result in undesired chemical reactions in the solution, gas mixture, the variante of FIG. 4 is to be preferred. The fluid led into the container 10 pushes the piston 18 towards the interior 11 of the container 10 and in this way reduces its volume to cause the pressure increase up over the bursting pressure of the at least one predetermined breaking point.

For preventing a leakage of the solution gas mixture from the interior 11 of the container 10 and/or a backflow of the pressure fluid into the fluid line a closing device 20 for example in the form of a valve or a predetermined breaking point such as a burst disk is provided as indicated in FIGS. 3 and 4.

Figure 5:
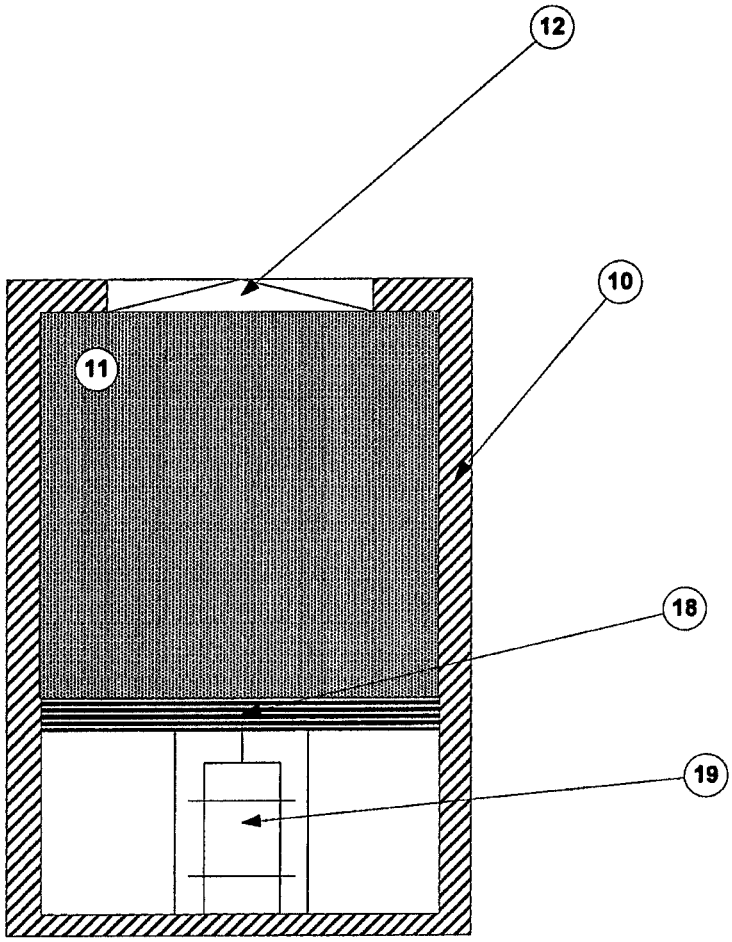
FIG. 5 shows a diagrammatic sectional view of an apparatus for distributing irritants or warfare agents according to a fifth embodiment of the invention.

A fifth embodiment having a further variante of the pressure generating means is illustrated in FIG. 5.

In FIG. 5, analogous to the configuration variantes of FIGS. 2 and 4, the volume of the interior 11 is reduced by means of a movable piston 18 to produce the pressure increase in the interior 11 of the container 10. Contrary to the examples shown in FIGS. 2 and 4, however, this piston 18 is not moved pyrotechnically or by means of a pressure fluid but by means of an electrical or electromotive drive 19.

In the embodiments of FIGS. 1 through 5 described above, each container 10 included, an interior 11, in which a completely metered dissolution or emulsion of the irritants or warfare agents in the liquefied solution gas has been housed. For improving the reliability of operation of the apparatus, however, it is also possible to provide the irritants or warfare agents and the solution gas separated from each other until the actuation of the apparatus. The advantage is that the accident and injury risk caused by unintentional releases because of a damaging of the apparatus is diminished since for example only the pure solution gas may be discharged in case of a damaging of the container 10. Corresponding configurations of the invention are explained below with reference to FIGS. 6 and 7.

Figure 6:
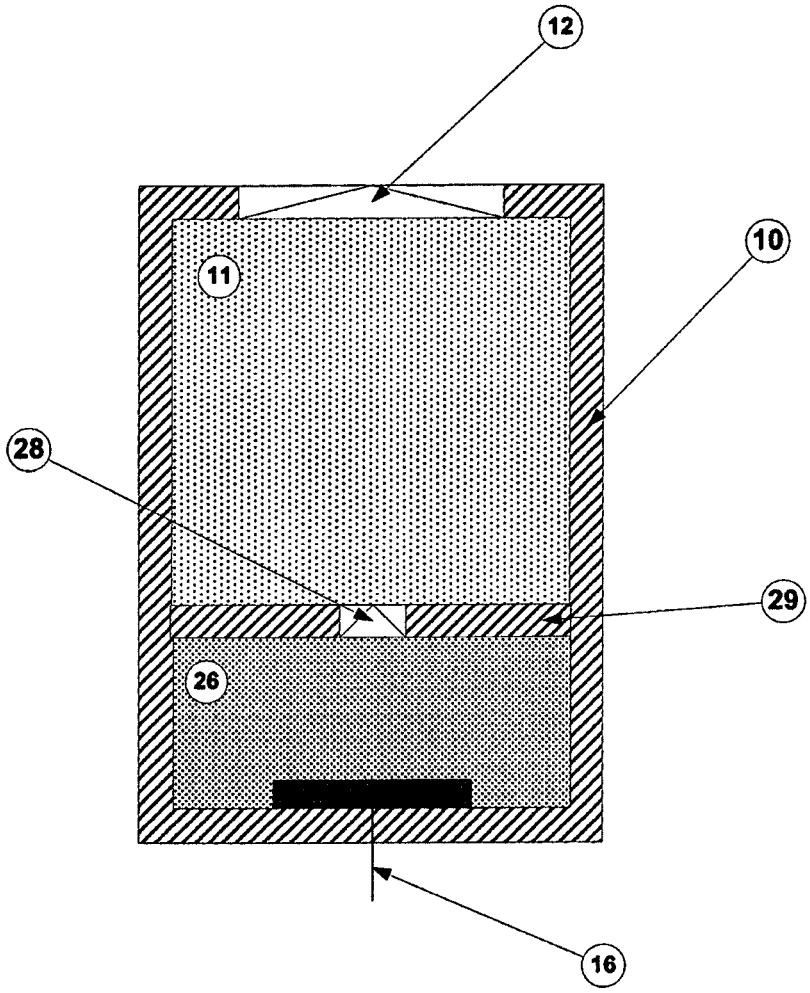
FIG. 6 shows a diagrammatic sectional view of an apparatus for distributing irritants or warfare agents according to a sixth embodiment of the invention.

As shown in FIG. 6, the container 10 besides the interior 11 also comprises another room 26 being separated from the interior 11. The other room 26 is separated from the interior 11 by a separation wall 29, which is not limited to a special design, construction and/or material selection and which is formed as a diaphragm, for example. The liquefied solution gas is in the interior 11, and the irritants or warfare agents are in the other room 26. The irritants or warfare agents in the other room 26 may be provided in form of a powder or may be dissolved in a liquefied gas or a liquid.

In addition, a pyrotechnic charge 14 is arranged in the other room 26, which firstly produces a pressure increase in the other room 26 upon its triggering by the ignition device 16. By way of this pressure increase in the other room 26 the separation between the interior 11 and the other room 26 of the container 10 is removed, for example by opening a (separation) valve or by bursting of a (separating) predetermined breaking point 25 in the separation wall 29 between the interior 11 and the other room 26 so that the irritants or warfare agents are injected under pressure into the solution gas in the interior 11.

By way of this pressure injection, the desired emulsion or dissolution of the irritants or warfare agents in the solution gas is produced in the interior 11 of the container 10. Due to the further increasing pressure in the other room 26 and, as a result, also in the interior 11, finally the inner pressure in the container 10 is increased up to the bursting pressure of the at least one predetermined breaking point 12. The discharge of the solution gas mixture through the opened predetermined breaking point 12 and the very fine distribution of the irritants or warfare agents in the ambient air then proceed as with the preceding embodiments in the way described above.

In a variante of this embodiment, the interior 11 and the other room 26 of the container 10 may be used also vice versa. This means, the irritants or warfare agents are in the interior 11 and the solution gas is filled in the other room 26 until the pressure generating means 14-16 removes the separation between the interior 11 and the other room 26 to provide the desired solution gas mixture in the container 10.

Figure 7:
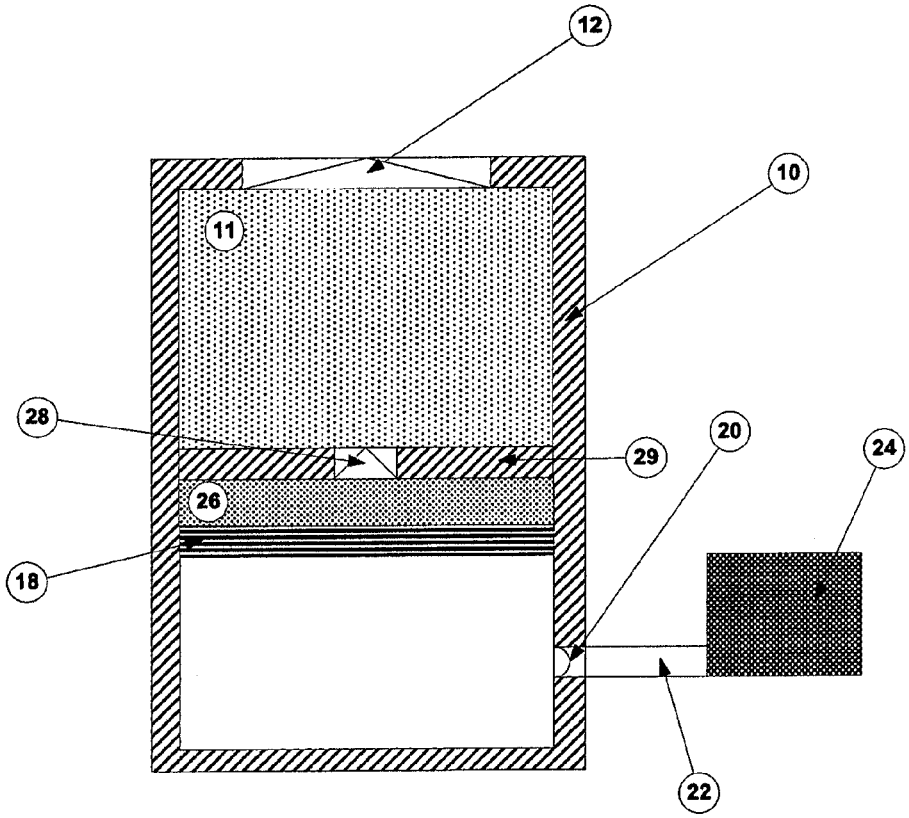
FIG. 7 shows a diagrammatic sectional view of an apparatus for distributing irritants or warfare agents according to a seventh embodiment of the invention.

In a still further variante of the embodiment of FIG. 7, the separation between the interior 11 and the other room 26 is not removed by the pyrotechnic charge 14 but by a separate opening mechanism. Upon actuation of the apparatus, this opening mechanism establishes a connection between the interior 11 and the other room 26 so that the desired emulsion or dissolution of the irritants or warfare agents in the solution gas can be made before the pyrotechnic charge 14 causes the pressure increase in the rooms 11 and 26 and therewith a bursting of the at least one predetermined breaking point 12. In this process, care has to be taken that the solution gas maintains its liquefied state of aggregation despite the volume expansion caused by the other room 26 to guarantee the later very fine distribution of the irritants or warfare agents in the ambient air.

The embodiment of FIG. 7 differs from that shown in FIG. 6 in the construction of the pressure generating means, on the one hand, and in the manner of the pressure increase, on the other hand. As shown in FIG. 7, the pressure generating means especially comprises the fluid source 24 and thus corresponds to that of the third and fourth embodiments. In addition, a movable piston 18 is provided within the other room 26 that effects a volume reduction of the other room 26 upon actuation of the pressure generating means 20-24 to produce the pressure increase in this way.

Naturally, also in this embodiment the variantes may be realized which have been explained in connection with the sixth embodiment of FIG. 6 above. In addition, both embodiments of FIGS. 6 and 7 may be combined with each other in any way; for example, also in the apparatus, of FIG. 6, a movable piston 18 can be arranged in the other room 26.

In a still further configuration of the invention (not shown), the solution gas and the irritants or warfare agents are kept in two different rooms of the container 10 separated from each other and then mixed to the desired solution gas mixture in the interior 11 in a first step, before the necessary overpressure in the interior 11 is produced in a second step to let the predetermined breaking point 12 burst.

Although the present invention has been described above in detail with reference to various embodiments and variantes the invention of course is not limited to these configurations but the skilled person will easily recognize numerous modifications and variations within the scope of the appending claims Of course, the invention is limited neither to a special kind of solution gas nor to a special kind of irritants or warfare agents. Also, adding additives is possible for discharge and distribution improvement. Further, there is no limitation to special amounts and mixture ratios of the solution gas and the irritants or warfare agents and the additives, if any.

In the embodiments described above and shown in the drawings, the containers 10 and their interiors 11, respectively, each have only one predetermined breaking point 12. In connection with the present invention, however, also a number of predetermined breaking points may be provided at different positions of the container.

Further, the apparatus according to the invention is not limited to special applications. For example, the apparatus may be fixedly installed as well as used as a single mobile device. Furthermore, an installation of the apparatus on stationary means such as buildings and the like as well anon mobile means such as vehicles and the like are possible. The apparatus according to the invention can be advantageously used in outdoor applications, but it can also be used in enclosed rooms.

The invention claimed is:

1. An apparatus for distributing irritants or warfare agents, comprising: a container having an interior being adapted for providing an irritant or warfare agent, which is dissolved or emulsified in a solution gas in its liquefied state of aggregation, which solution gas is in gaseous condition at room temperature and atmospheric pressure or ambient pressure, wherein said container has at least one predetermined breaking point, which produces an opening of the interior to the surroundings of said container at a predetermined bursting pressure in said interior, wherein said predetermined bursting pressure is greater than an evaporation pressure of said solution gas;

said apparatus further comprises a pressure generating means for generating an increased pressure in said interior of said container that is greater than said bursting pressure of said at least one predetermined breaking point;

said solution gas being housed in said interior of said container;

said container comprising another room separated from said interior by a separation member and housing the irritant or the warfare agent, wherein the separation member between said interior and said other room can be removed.

2. The apparatus according to claim 1, wherein said pressure generating means is configured and arranged for generating the pressure increase directly in said interior of said container.

3. The apparatus according to claim 1, wherein said pressure generating means is configured and arranged for acting upon a movable piston to generate the pressure increase in said interior of said container by volume reduction of said interior.

4. The apparatus according to claim 3, wherein said pressure generating means comprises an electrical drive for moving said piston.

5. The apparatus according to claim 1 wherein said pressure generating means comprises a pyrotechnical charge, wherein the ignition of said pyrotechnic charge causes the pressure increase in said interior of said container.

6. The apparatus according to claim 1, wherein said pressure generating means comprises a fluid source, said fluid source being separated from said interior of said container, wherein a fluid under pressure can be taken from said fluid source to cause the pressure increase in said interior of said container.

7. The apparatus according to claim 1, wherein an opening device is provided for removing the separation member between said interior and said other room of said container before an actuation of said pressure generating means.

8. The apparatus according to claim 1, wherein said pressure generating means is configured and arranged for firstly removing the separation member between said interior and said other room of said container and then generating the pressure increase in said interior of said container.

9. An apparatus for distributing irritants or warfare agents, comprising: a container having an interior being adapted for providing an irritant or warfare agent, which is dissolved or emulsified in a solution gas in its liquefied state of aggregation, which solution gas is in gaseous condition at room temperature and atmospheric pressure or ambient pressure, wherein said container has at least one predetermined breaking point, which produces an opening of the interior to the surroundings of said container at a predetermined bursting pressure in said interior, wherein said predetermined bursting pressure is greater than an evaporation pressure of said solution gas;

said apparatus further comprises a pressure generating means for generating an increased pressure in said interior of said container that is greater than said bursting pressure of said at least one predetermined breaking point;

the irritant or warfare agent is housed in said interior of said container;

said container comprising another room separated from said interior by a separation member and housing the solution gas, wherein the separation member between said interior and said other room can be removed.

10. The apparatus according to claim 9, wherein said pressure generating means is configured and arranged for generating the pressure increase directly in said interior of said container.

11. The apparatus according to claim 9, wherein said pressure generating means is configured and arranged for acting upon a movable piston to generate the pressure increase in said interior of said container by volume reduction of said interior.

12. The apparatus according to claim 11, wherein said pressure generating means comprises an electrical drive for moving said piston.

13. The apparatus according to claim 9, wherein said pressure generating means comprises a pyrotechnical charge, wherein the ignition of said pyrotechnic charge causes the pressure increase in said interior of said container.

14. The apparatus according to claim 9, wherein said pressure generating means comprises a fluid source, said fluid source being separated from said interior of said container, wherein a fluid under pressure can be taken from said fluid source to cause the pressure increase in said interior of said container.

15. The apparatus according to claim 9, wherein an opening device is provided for removing the separation member between said interior and said other room of said container before an actuation of said pressure generating means.

16. The apparatus according to claim 9, wherein said pressure generating means is configured and arranged for firstly removing the separation member between said interior and said other room of said container and then generating the pressure increase in said interior of said container.

* * * * *